US011223138B2

(12) United States Patent
Rogers

(10) Patent No.: US 11,223,138 B2
(45) **Date of Patent: *Jan. 11, 2022**

(54) WAVEGUIDE TO STRIPLINE FEED

(71) Applicant: The Boeing Company, Chicago, IL (US)

(72) Inventor: John E. Rogers, Owens Cross Roads, AL (US)

(73) Assignee: The Boeing Company, Chicago, IL (US)

( * ) Notice: Subject to any disclaimer, the term of this patent is extended or adjusted under 35 U.S.C. 154(b) by 119 days.

This patent is subject to a terminal disclaimer.

(21) Appl. No.: 16/424,951

(22) Filed: May 29, 2019

(65) Prior Publication Data

US 2020/0381837 A1 Dec. 3, 2020

(51) Int. Cl.

| | |
|---|---|
| ***H01Q 13/06*** | (2006.01) |
| ***H01Q 1/22*** | (2006.01) |
| ***H01Q 13/00*** | (2006.01) |

(52) U.S. Cl.

CPC ..... *H01Q 13/00* (2013.01); *H01Q 1/2283* (2013.01)

(58) Field of Classification Search

CPC ..... H01Q 13/00; H01Q 13/06; H01Q 13/10; H01Q 13/106; H01Q 1/2283; H01P 3/00; H01P 3/08; H01P 5/085; H01P 11/003

See application file for complete search history.

(56) References Cited

U.S. PATENT DOCUMENTS

| | | | | |
|---|---|---|---|---|
| 6,052,087 | A * | 4/2000 | Ishikawa | H01Q 13/10 343/700 MS |
| 10,833,419 | B1 * | 11/2020 | Rogers | H01Q 13/06 |
| 2002/0057220 | A1 * | 5/2002 | Sabet | H01Q 1/40 343/700 MS |
| 2009/0066597 | A1 * | 3/2009 | Yang | H01Q 13/22 343/771 |
| 2010/0245204 | A1 * | 9/2010 | Lee | H01Q 9/045 343/860 |
| 2019/0312326 | A1 * | 10/2019 | Rogers | H01P 5/08 |

OTHER PUBLICATIONS

Ponchak, G.E., Simons, R.N., "A new rectangular waveguide to coplanar waveguide transition," IEEE MTT-S, May 1990.

Grabherr, W., et al., "Microstrip to waveguide transition compatible with mm-wave integrated circuits," IEEE Transactions on Microwave Theory and Techniques, Sep. 1994.

Simon, W., et al., "A novel coplanar transmission line to rectangular waveguide transition," IEEE MTT-S, Jun. 1998.

(Continued)

*Primary Examiner* — Thai Pham

(74) *Attorney, Agent, or Firm* — Parsons Behle & Latimer

(57) ABSTRACT

An apparatus may include a substrate assembly having a first side and a second side. The apparatus may further include a waveguide antenna element positioned on the first side of the substrate assembly. The apparatus may also include a first reference ground plane positioned on the first side of the substrate assembly and enclosing the waveguide antenna. The apparatus may include a stripline positioned within the substrate assembly. The apparatus may further include a second reference ground plane positioned on the second side of the substrate assembly.

20 Claims, 6 Drawing Sheets

(56) References Cited

OTHER PUBLICATIONS

Kaneda, N., et al., "A broad-band microstrip-to-waveguide transition using quasi-Yagi antenna," IEEE Transactions on Microwave Theory and Techniques, Dec. 1999.
Lin, T.H., Wu, R.B., "CPW to waveguide transition with tapered slotline probe," IEEE Microwave and Wireless Components Letters, Jul. 2001.
Iizuka, H., et al., "Millimeter-wave microstrip line to waveguide transition fabricated on a single layer dielectric substrate," IEICE Transactions on Communications, Jun. 2002.

* cited by examiner

WAVEGUIDE TO STRIPLINE FEED

FIELD OF THE DISCLOSURE

This disclosure is related to the field of using a waveguide to transmit signals to a stripline feed in a first signal direction and using a stripline feed to transmit signals to a waveguide in a second signal direction.

BACKGROUND

Waveguides are used in many radio frequency (RF) applications for low-loss signal propagation. For high frequency applications in particular, waveguides may be preferred over coaxial transmission lines. In some applications, it may be desirable to transition waveguides to a planar stripline. Planar striplines may be useful for signal transmission to various components on an RF board.

In order for a waveguide to transition to a planar stripline, multiple adapters are typically required. First, a waveguide-to-coax adapter may transition a waveguide to a coax. Second, a coax-to-microstrip adapter may transition a coax to a microstrip. Finally, the microstrip may be transitioned to a planar stripline on an RF board. Adapters associated with these transitions can be cost prohibitive at higher frequencies because such adapters are small and may be formed using high precision machining. Also, the size and weight of existing waveguide-to-coax transitions make them non-ideal for many applications.

SUMMARY

In this disclosure, a low-loss waveguide to stripline feed apparatus is described. In an embodiment, a waveguide to stripline feed apparatus includes a substrate assembly having a first side and a second side. The apparatus further includes a waveguide antenna element positioned on the first side of the substrate assembly. The apparatus also includes a first reference ground plane positioned on the first side of the substrate assembly and enclosing the waveguide antenna element. The apparatus includes a stripline positioned within the substrate assembly. The apparatus further includes a second reference ground plane positioned on the second side of the substrate assembly.

In some embodiments, the apparatus includes a waveguide attached to the first side of the substrate assembly, enclosing the waveguide antenna element, and electrically connected to the first reference ground plane. In some embodiments, the waveguide is a circular waveguide. In some embodiments, the apparatus includes one or more substrates positioned between the waveguide antenna element and the stripline, where the stripline is proximity coupled to the waveguide antenna element. In some embodiments, the apparatus includes a slot defined within the waveguide antenna element. In some embodiments, the apparatus includes one or more vias electrically shorting the first reference ground plane to the second reference ground plane. In some embodiments, the waveguide antenna element and the first reference ground plane are positioned on a first substrate, where the stripline is positioned on a second substrate, and where the second reference ground plane is positioned on a third substrate. In some embodiments, the first substrate, the second substrate, and the third substrate each include a dielectric material. In some embodiments, the apparatus includes bonding layers positioned between each of the first substrate, the second substrate, and the third substrate.

In an embodiment, a method includes providing a waveguide antenna element and a first reference ground plane on a first substrate, the first reference ground plane enclosing the waveguide antenna element. The method further includes providing a stripline on a second substrate. The method also includes providing a second reference ground plane on a third substrate. The method includes bonding the first substrate, second substrate, and third substrate together to form a substrate assembly having a first side and a second side, where the waveguide antenna element and the first reference ground plane are positioned on the first side, and wherein the second reference ground plane is positioned on the second side.

In some embodiments, the method includes attaching a waveguide to the first side of the substrate assembly, where the waveguide encloses the waveguide antenna element and is electrically connected to the first reference ground plane. In some embodiments, the waveguide is a circular waveguide. In some embodiments, the method includes positioning one or more additional substrates between the waveguide antenna element and the stripline, where the stripline is proximity coupled to the waveguide antenna element. In some embodiments, the method includes providing a slot within the waveguide antenna element. In some embodiments, the method includes providing one or more vias electrically shorting the first reference ground plane to the second reference ground plane. In some embodiments, providing the waveguide antenna element, the first reference ground plane, the stripline, and the second reference ground plane is performed using a subtractive process, an additive process, or a combination thereof. In some embodiments, the subtractive process includes laser etching, milling, wet etching, or a combination thereof, and the additive process includes printing, deposition, or a combination thereof. In some embodiments, the bonding of the first substrate, the second substrate, and the third substrate together includes positioning bonding layers between each of the first substrate, the second substrate, and the third substrate.

In an embodiment, a method includes receiving a time-varying electric field signal at a waveguide antenna element positioned on a first side of a substrate assembly, wherein the time-varying electric field signal induces a current signal having a circular behavior within the waveguide antenna element. The method further includes generating a current signal at a stripline proximity coupled to the waveguide antenna element. In some embodiments, the time-varying electric field signal has a frequency of about 10 gigahertz (GHz).

Figure 1:
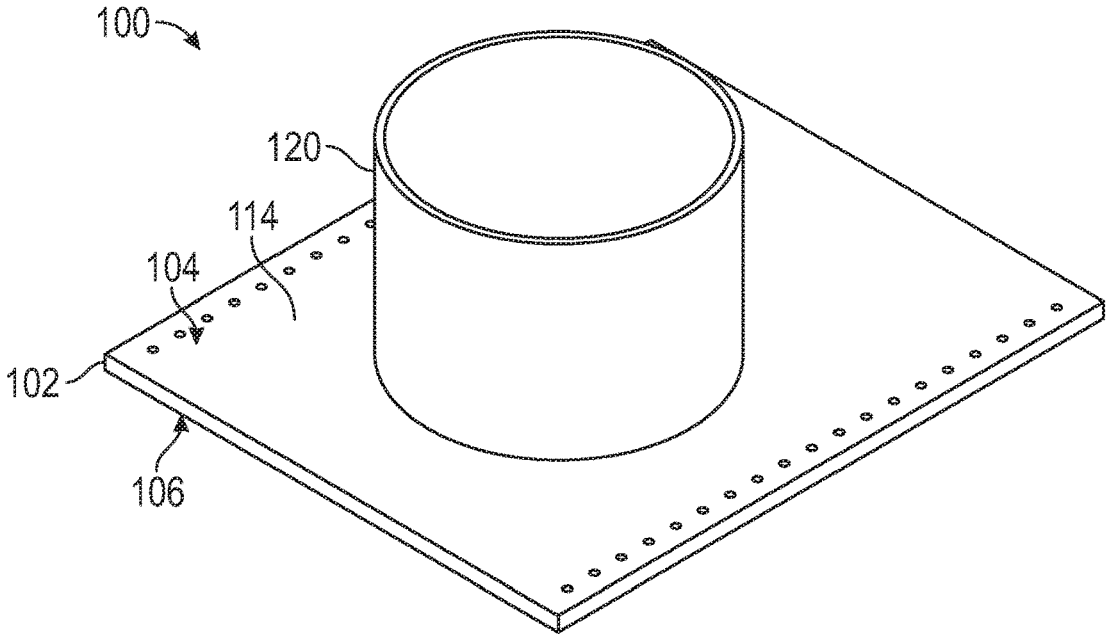
FIG. 1 is a schematic perspective view of an embodiment of a waveguide to stripline feed apparatus.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

As used herein, the terms "top," "bottom," "first," and "second" can refer to relative directions or positions of features in the apparatus shown in the Figures. These terms, however, should be construed broadly to include apparatus having other orientations, such as inverted or inclined orientations where top/bottom, over/under, above/below, up/down, and left/right can be interchanged depending on the orientation.

Figure 2:
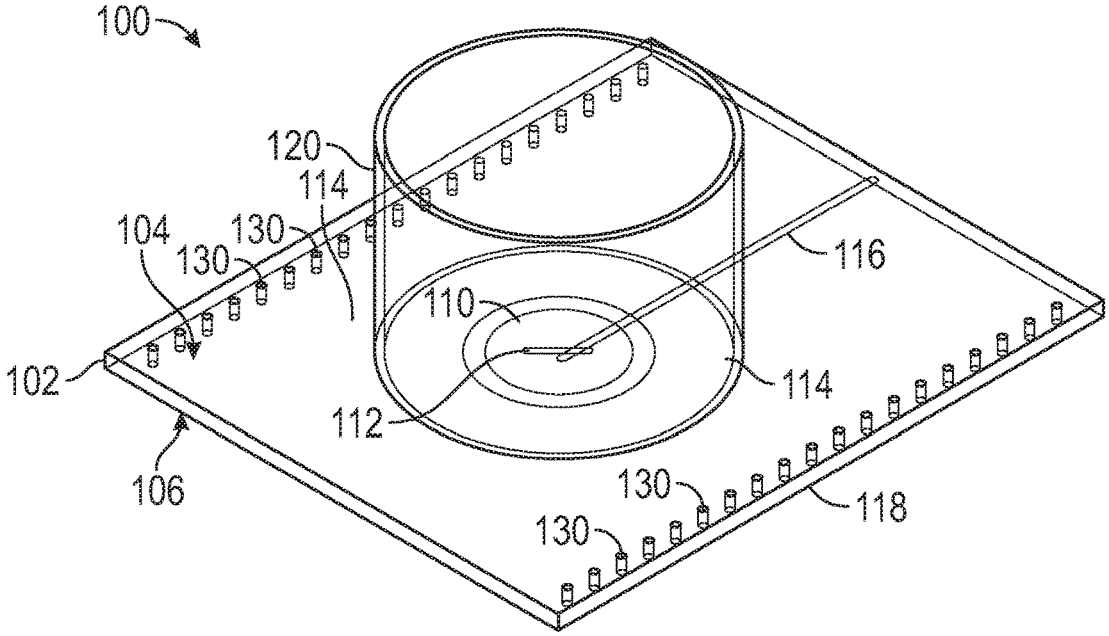
FIG. 2 is a transparent schematic perspective view of an embodiment of a waveguide to stripline feed apparatus.

Referring to FIGS. 1 and 2, an embodiment of a waveguide to stripline feed apparatus 100 is depicted. The apparatus 100 may include a substrate assembly 102 having a first side 104 and a second side 106. Features positioned on the first side 104 of the substrate assembly 102 may be described with reference to FIG. 1. Features positioned within the substrate assembly 102 or on the second side 106 of the substrate assembly 102 may be described with reference to FIG. 2.

Referring to FIG. 1, on the first side 104 of the substrate assembly 102, the apparatus 100 may include a first reference ground plane 114. A waveguide 120 may also be attached to the first side 104 of the apparatus 100. The waveguide 120 may be electrically connected to the first reference ground plane 114.

Referring to FIG. 2, the apparatus may include a waveguide antenna element 110. The waveguide antenna element 110 may be a circular waveguide antenna element and may include a slot 112 defined therein. The slot 112 may enable a current with circular behavior to be induced within the waveguide antenna element 110 in response to reception of a signal at the waveguide antenna element 110. A waveguide 120 may be positioned on the first side 104 of the substrate assembly 102 enclosing the waveguide antenna element 110. As used herein, "enclosing" means that the waveguide 120 surrounds the waveguide antenna element 110 along a plane as shown in FIG. 1. Although FIG. 1 depicts the waveguide 120 as a circular waveguide, other shapes, e.g., rectangular, are also possible. Furthermore, the waveguide antenna element 110 may also be other shapes, e.g., rectangular.

The waveguide 120 may be electrically connected to the first reference ground plane 114 with some of the first reference ground plane 114 being enclosed by the waveguide 120. This may enable interference with the transition between the waveguide 120 and a stripline 116 to be reduced as compared to other systems which may first transition to a microstrip line before transitioning to a stripline.

The apparatus 100 may include a stripline 116 within the substrate assembly 102. The stripline 116 may be proximity coupled to the waveguide antenna element 110. In other words, the stripline 116 may be capacitively coupled with the waveguide antenna element 110 such that a time-varying electrical voltage within the waveguide antenna element 110 may induce a time-varying electrical current within the stripline 116.

On the second side 106 of the substrate assembly 102, the apparatus 100 may include a second reference ground plane 118, which may be electrically shorted to the first reference ground plane 114 through one or more electrical vias 130. The second reference ground plane 118 may extend over the length of the second side 106 of the apparatus 100, which may be more easily seen in FIG. 3. The first reference ground plane 114 and the second reference ground plane 118 may overlap the stripline 116, and thereby provide an encircling reference ground plane in order to function as a stripline.

Figure 3:
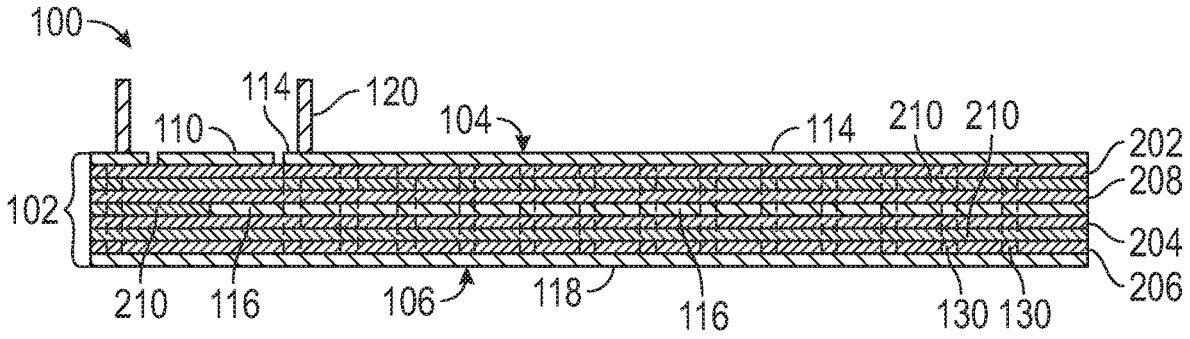
FIG. 3 is a schematic cross-sectional view of an embodiment of a waveguide to stripline feed apparatus.

Referring to FIG. 3, a cross-sectional view of the apparatus 100 is depicted. It should be noted that layer thicknesses and feature proportions may be adjusted in FIG. 3 as compared to FIGS. 1 and 2 for illustrative purposes.

As shown in FIG. 3, the substrate assembly 102 may include at least a first substrate 202, a second substrate 204, a third substrate 206, and an optional fourth substrate 208. The first side 104 of the substrate assembly 102 may correspond to the first substrate 202 while the second side 106 of the substrate assembly 102 may correspond to the third substrate 206. The waveguide antenna element 110, the first reference ground plane 114, and the waveguide 120 may be positioned on the first substrate 202. The stripline 116 may be formed on the second substrate 204 within the substrate assembly 102.

The second reference ground plane 118 may be positioned on the third substrate 206. The optional fourth substrate 208 may be positioned between the first substrate 202 and second substrate 204 for proximity coupling spacing purposes. Although not shown, additional substrates may also be included between the first substrate 202, second substrate 204, and third substrate 206 for spacing purposes. The electrical vias 130 may pass through each of the substrates 202-208 to electrically short the first reference ground plane 114 to the second reference ground plane 118. The substrates 202-208 may be bonded together by one or more bonding layers 210 (e.g., adhesive layers).

Figure 4:
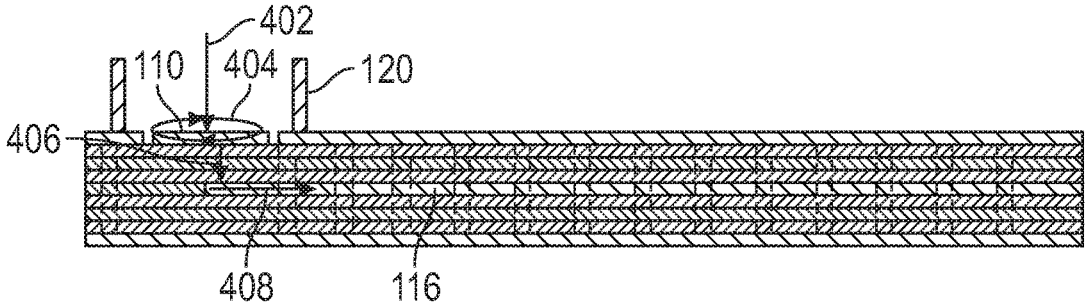
FIG. 4 is a schematic cross-sectional view of an embodiment of a waveguide to stripline feed apparatus showing a first time-varying electric field signal path through the apparatus.

Operation of the apparatus 100 is described with reference to FIGS. 4 and 5. Referring to FIG. 4, a time-varying electric field signal 402 may be incident to the waveguide antenna element 110 from the waveguide 120. The time-varying electric field signal 402 may induce a current signal 404 with circular behavior within the waveguide antenna element 110. In response to the current signal 404, a current signal 406 may be generated and coupled to the stripline 116 to produce a current signal 408.

Figure 5:
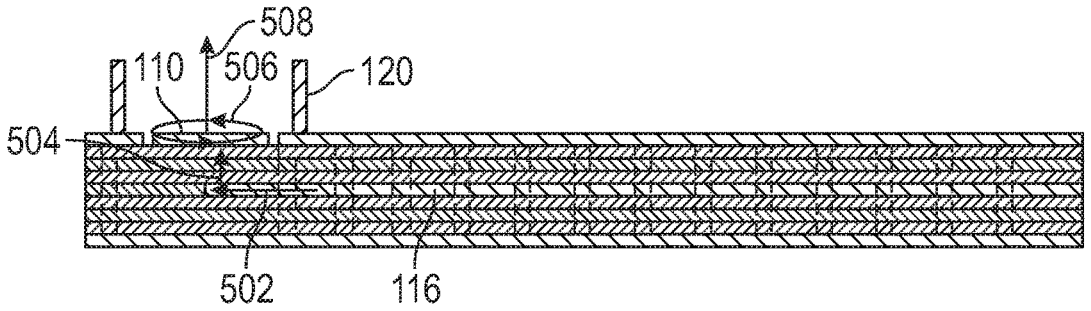
FIG. 5 is a schematic cross-sectional view of an embodiment of a waveguide to stripline feed apparatus showing a second time-varying electric field signal path through the apparatus.

Referring to FIG. 5, a current signal 502 may be transmitted at the stripline 116. The current signal 502 may produce a current signal 504, which may generate a current signal 506 with circular behavior within the waveguide antenna element 110. In response to the current signal 506 a time-varying electric field signal 508 may be generated for transmission through the waveguide 120.

A benefit of the apparatus 100 is that the apparatus 100 may have a reduced size, weight, and cost in comparison to existing waveguide-to-coax adapters and further coax-to-stripline adapters. Further, the substrate assembly 102 may exhibit a lower profile as compared to existing adapters. In some embodiments, the apparatus 100 may operate when the time-varying electric field signals 402, 508 have frequencies of about 10 GHz. Other advantages may exist.

Figure 6A:
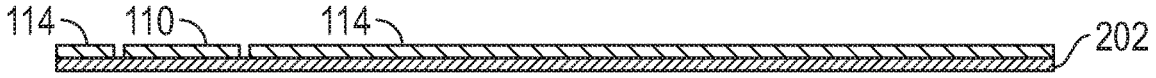
FIG. 6A is a schematic cross-sectional view of an example of a first substrate including a waveguide antenna element and a ground plane.
Figure 6B:
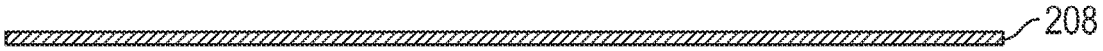
FIG. 6B is a schematic cross-sectional view of an example of an optional fourth substrate.
Figure 6C:
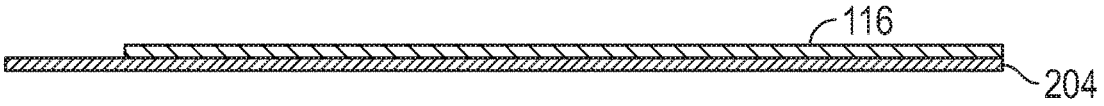
FIG. 6C is a schematic cross-sectional view of an example of a second substrate including a stripline.
Figure 6D:
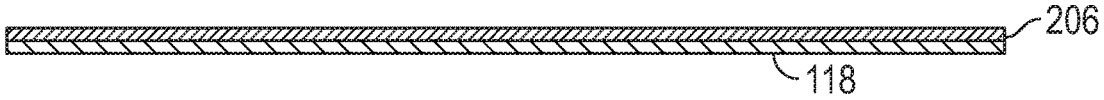
FIG. 6D is a schematic cross-sectional view of an example of a third substrate including a ground plane.

FIG. 6A is a schematic cross-sectional view of an embodiment of a first substrate 202 having a waveguide antenna element 110 and first reference ground plane 114 positioned thereon. FIG. 6B is a schematic cross-sectional view of an embodiment of an optional fourth substrate 208. FIG. 6C is a schematic cross-sectional view of an embodiment of a second substrate 204 with a stripline 116 positioned thereon. FIG. 6D is a schematic cross-sectional view of an embodiment of a third substrate 206 having a second reference ground plane 118 positioned thereon.

Figure 6E:
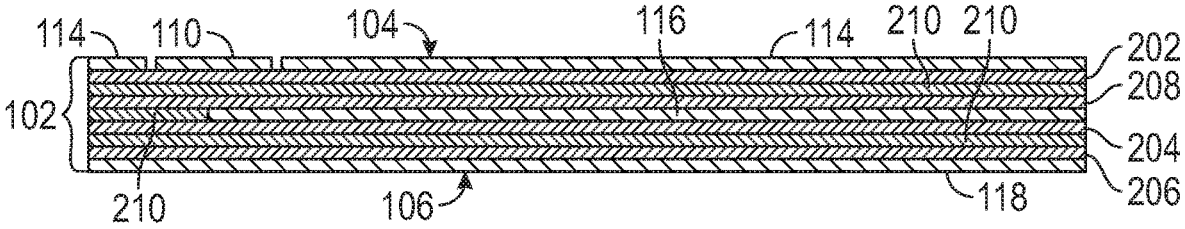
FIG. 6E is a schematic cross-sectional view of an example of a first substrate, second substrate, third substrate, and an optional fourth substrate bonded together to form a substrate assembly.

FIG. 6E is a schematic cross-sectional view of an embodiment of a substrate assembly 102 formed by bonding together the first substrate 202, the second substrate 204, the third substrate 206, and the fourth substrate 208. The substrates 202-208 may be bonded together via bonding layers 210, which may include adhesive, bonding material, or laminated material as would be appreciated by one of ordinary skill in the art having the benefit of this disclosure. More or fewer layers may be used to form the substrate assembly 102 as would be appreciated by one of ordinary skill in the art having the benefit of this disclosure. Further, the formation of the substrates 202-208 may be performed through additive processes, subtractive processes, or combinations thereof.

Figure 6F:
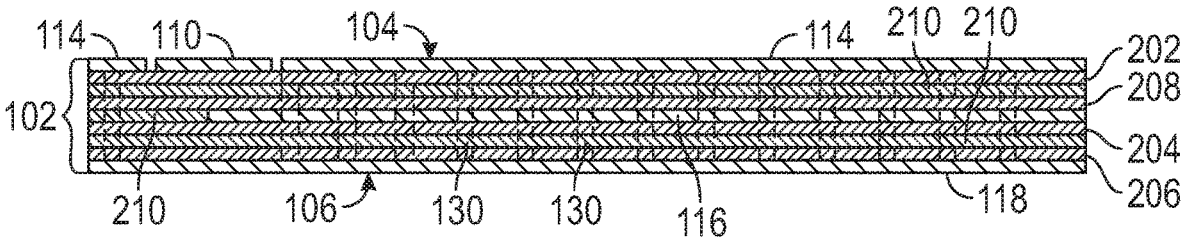
FIG. 6F is a schematic cross-sectional view of an embodiment of a waveguide to stripline feed substrate assembly.

FIG. 6F is a schematic cross-sectional view of an embodiment of a substrate assembly 102 having a set of electrical vias 130 formed therein. The set of electrical vias 130 may electrically short the first reference ground plane 114 to the second reference ground plane 118. The stripline 116 may be positioned between the first reference ground plane 114 and the second reference ground plane 118.

Figure 6G:
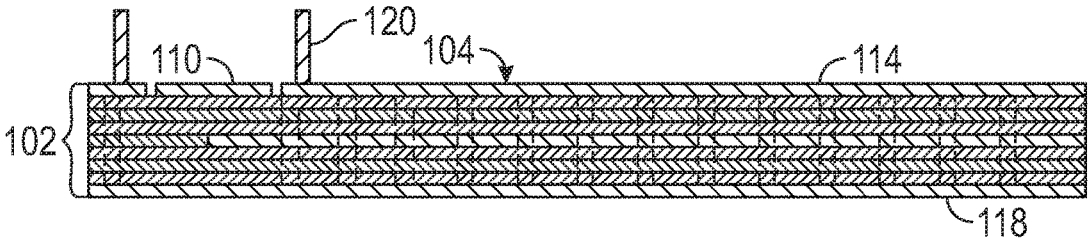
FIG. 6G is a schematic cross-sectional view of an embodiment of a waveguide to stripline feed substrate assembly.

FIG. 6G is a schematic cross-sectional view of an embodiment of a substrate assembly 102. As shown in FIG. 6G, after the substrate assembly 102 is formed, a waveguide 120 may be attached to the first side 104 and may encompass the waveguide antenna element 110. The waveguide 120 may further be electrically connected to the first reference ground plane 114. As discussed herein, the apparatus 100 may be used to transmit signals to the stripline 116 using the waveguide 120.

Figure 7:
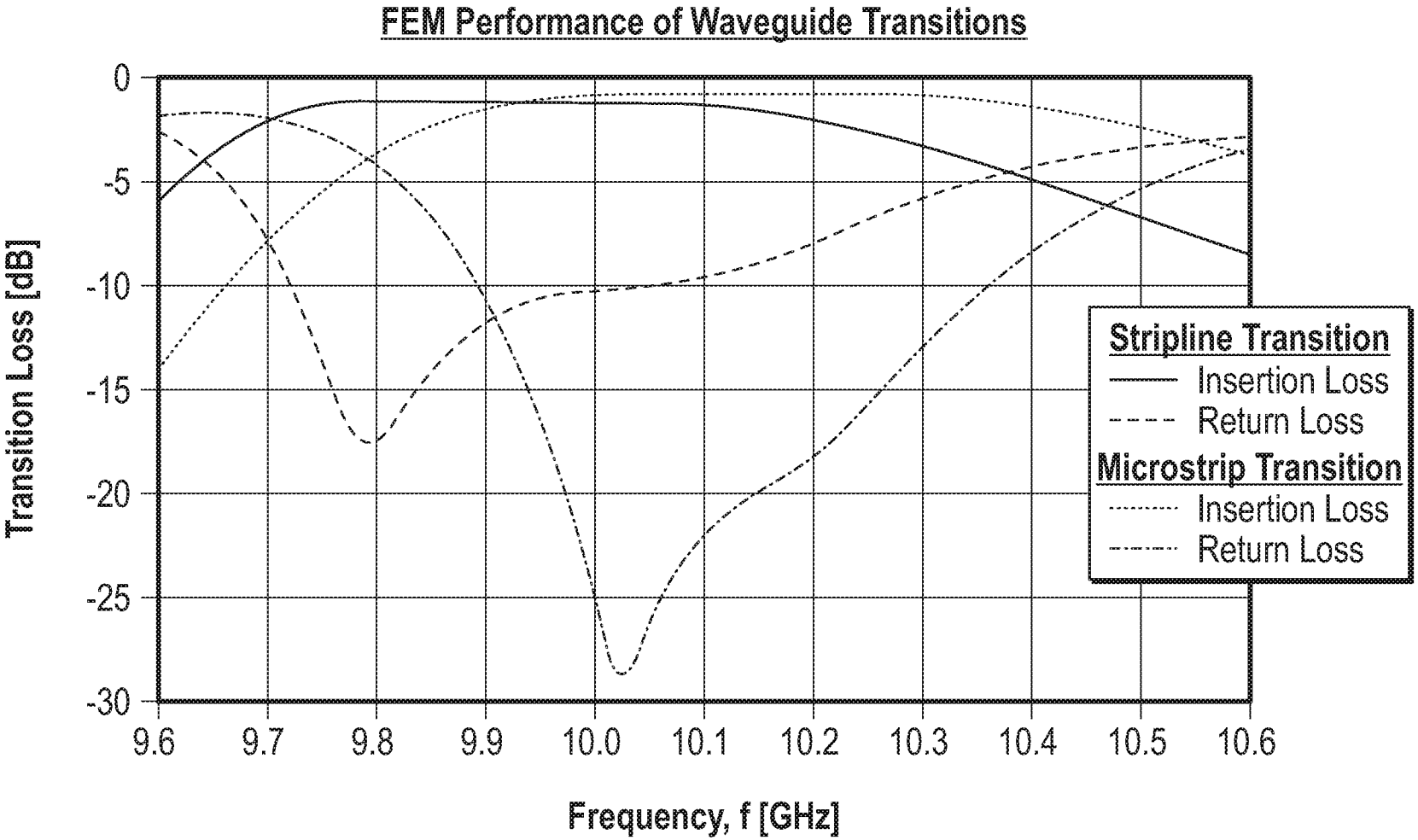
FIG. 7 is a diagram depicting performance of different transition types.

Referring to FIG. 7, a diagram depicting performance of different waveguide transition types, i.e., a stripline transition and a microstrip transition, is depicted. In the example of FIG. 7, a numerical model of a waveguide to stripline feed designed to operate near 10 GHz was developed using a finite element method (FEM) solver to predict performance. For comparison, a waveguide to microstrip transition is also shown. The model for the stripline transition predicts an insertion loss of about 1.2 decibel (dB), a 3 dB bandwidth of about 710 megahertz (MHz), and about a 2:1 voltage standing wave ratio (VSWR) impedance bandwidth of about 400 MHz. The microstrip transition, by comparison, has an insertion loss of about 0.8 dB, a 3 dB bandwidth of about 800 MHz, and a 2:1 VSWR impedance bandwidth of about 480 MHz.

Figure 8:
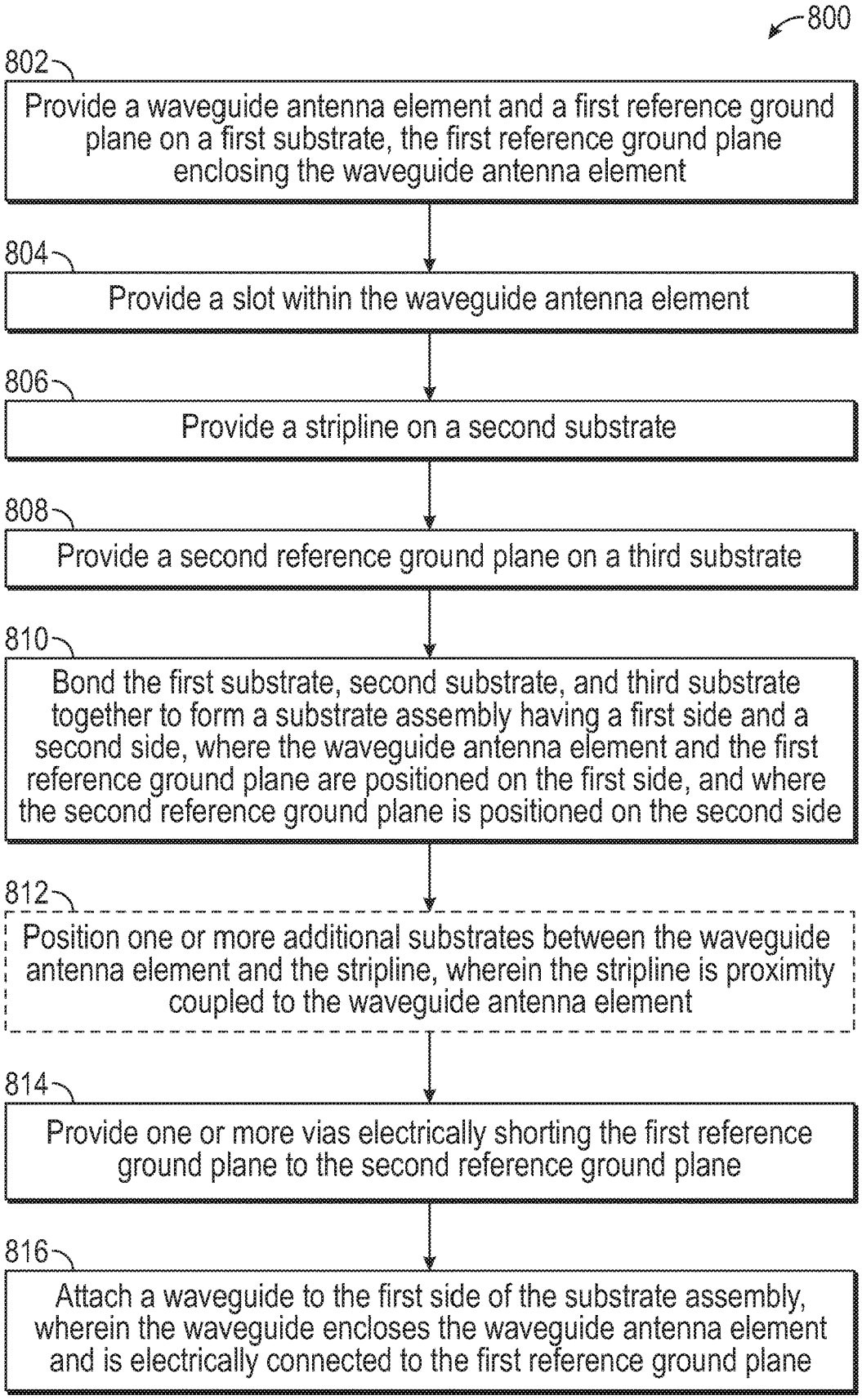
FIG. 8 is a flow diagram depicting an embodiment of a method for forming a waveguide to stripline feed apparatus

FIG. 8 is a flow chart of an embodiment of a method 800 of the present disclosure. The method 800 may include providing a waveguide antenna element and a first reference ground plane on a first substrate, at 802. For example, the waveguide antenna element 110 and the first reference ground plane 114 may be formed on the first substrate 202.

The method 800 may further include providing a slot within the waveguide antenna element, at 804. For example, the slot 112 may be provided in the waveguide antenna element 110.

The method 800 may also include providing a stripline on a second substrate, at 806. For example, the stripline 116 may be formed on the second substrate 204.

The method 800 may also include providing a second reference ground plane on a third substrate, at 808. For example, the second reference ground plane 118 may be formed on the third substrate 206.

The method 800 may include bonding the first substrate, the second substrate, and the third substrate together to form a substrate assembly having a first side and a second side, where the waveguide antenna element and the first reference ground plane are positioned on the first side, and where the second reference ground plane is positioned on the second side, at 810. For example, the first substrate 202, the second substrate 204, and the third substrate 206 may be bonded together to form the substrate assembly 102.

The method 800 may also optionally include positioning one or more additional substrates between the waveguide antenna element and the strapline, where the stripline is proximity coupled to the stripline antenna element, at 812. For example, the one or more additional substrates, such as the fourth substrate 208, may be positioned between the waveguide antenna element 110 and the stripline 116.

The method 800 may include providing one or more vias electrically shorting the first reference ground plane to the second reference ground plane, at 814. For example, the one or more vias 130 may be formed and may electrically short the first reference ground plane 114 to the second reference ground plane 118.

The method 800 may further include attaching a waveguide to the first side of the substrate assembly, the waveguide enclosing the waveguide antenna element, and the waveguide being electrically connected to the first reference ground plane, at 816. For example, the waveguide 120 may be attached to the first side 104 of the substrate assembly 102.

In some embodiments of the method 800, providing the waveguide antenna element, the first reference ground plane, the stripline, and the second reference ground plane is performed using a subtractive process, an additive process, or a combination thereof. Further, the subtractive process may include laser etching, milling, wet etching, or a combination thereof, and the additive process may include printing, deposition, or a combination thereof.

Figure 9:
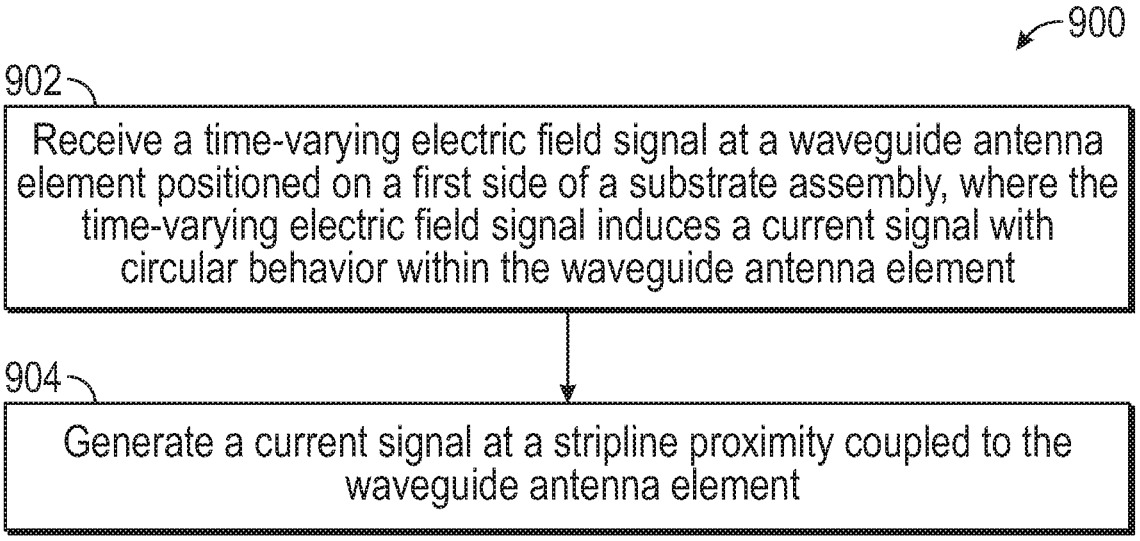
FIG. 9 is a flow diagram depicting an embodiment of a method for receiving a time-varying electric field signal at a waveguide to stripline feed apparatus.

Referring to FIG. 9, an embodiment of a method 900 for receiving a time-varying electric field signal at a waveguide to stripline feed apparatus is depicted. The method 900 may include receiving a first time-varying electric field signal at a waveguide antenna element positioned on a first side of a substrate assembly, where the first time-varying electric field induces a current signal with circular behavior within the waveguide antenna element, at 902. For example, the first time-varying electric field signal 402 may be received at the waveguide antenna element 110 and may induce the current signal 404 with circular behavior within the waveguide antenna element 110.

The method 900 may further include generating a current signal at a stripline proximity coupled to the waveguide antenna element, at 904. For example, the current signal 408 may be generated at the stripline 116, which may be proximity coupled to the waveguide antenna element 110. Thus, the method 900 may be used for transmitting signals to the stripline 116 with the waveguide 120.

Figure 10:
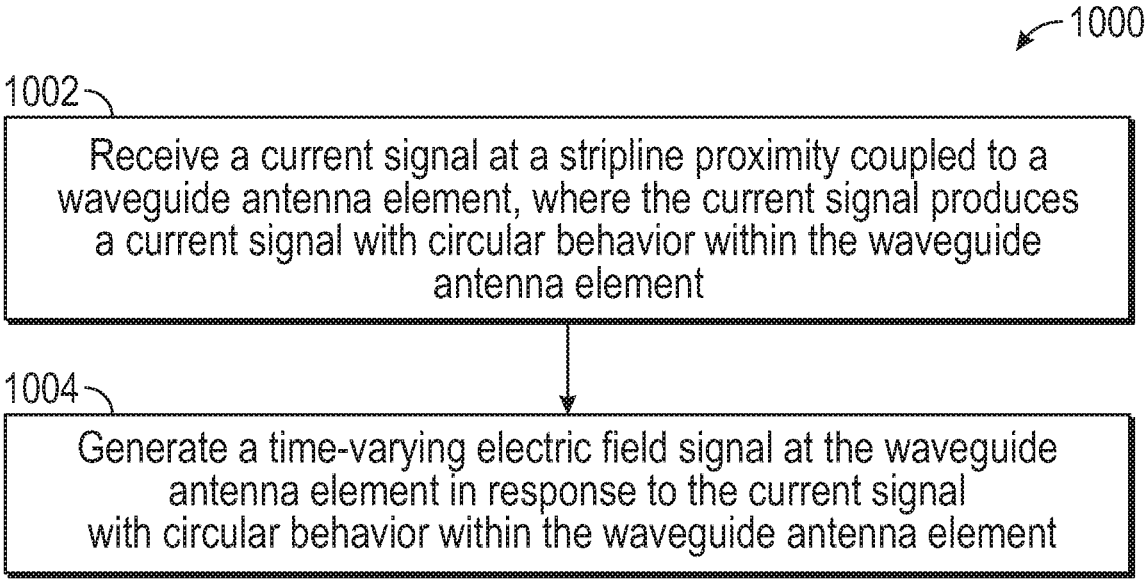
FIG. 10 is a flow diagram depicting an embodiment of a method for transmitting a time-varying electric field signal at a waveguide to stripline feed apparatus.

FIG. 10 is a flow diagram depicting an embodiment of a method 1000 for transmitting a time-varying electric field signal at a waveguide to stripline feed apparatus. The method 1000 may include receiving a current signal at a stripline proximity coupled to a waveguide antenna element, where the current signal produces a current signal with circular behavior within the waveguide antenna element, at 1002. For example, the current signal 502 may be received at the stripline 116, which may produce the current signal 506 within the waveguide antenna element 110.

The method 1000 may further include generating a time-varying electric field signal at the waveguide antenna element in response to the current signal with circular behavior within the waveguide antenna element, at 1004. For example, the time-varying electric field signal 508 may be generated at the waveguide antenna element 110.

Although this disclosure has been described in terms of certain embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof

What is claimed is:

1. An apparatus comprising:

a substrate assembly having a first side and a second side;

a waveguide antenna element positioned on the first side of the substrate assembly on a first substrate of the substrate assembly;

a first reference ground plane positioned on the first side of the substrate assembly on the first substrate of the substrate assembly and enclosing the waveguide antenna element;

a stripline positioned within the substrate assembly on a second substrate of the substrate assembly; and a second reference ground plane positioned on the second side of the substrate assembly on a third substrate of the substrate assembly.

2. The apparatus of claim 1, further comprising:

a waveguide attached to the first side of the substrate assembly, the waveguide enclosing the waveguide antenna element, and the waveguide electrically connected to the first reference ground plane.

3. The apparatus of claim 2, wherein the waveguide is a circular waveguide.

4. The apparatus of claim 1, further comprising:

one or more additional substrates positioned between the waveguide antenna element and the stripline, wherein the stripline is proximity coupled to the waveguide antenna element.

5. The apparatus of claim 1, further comprising:

a slot defined within the waveguide antenna element.

6. The apparatus of claim 1, further comprising:

one or more vias electrically shorting the first reference ground plane to the second reference ground plane.

7. The apparatus of claim 1, wherein the first substrate, the second substrate, and the third substrate each include a dielectric material.

8. The apparatus of claim 1, further comprising:

bonding layers positioned between each of the first substrate, the second substrate, and the third substrate.

9. A method comprising:

providing a waveguide antenna element and a first reference ground plane on a first substrate, the first reference ground plane enclosing the waveguide antenna element;

providing a stripline on a second substrate;

providing a second reference ground plane on a third substrate; and bonding the first substrate, second substrate, and third substrate together to form a substrate assembly having a first side and a second side, wherein the waveguide antenna element and the first reference ground plane are positioned on the first side, and wherein the second reference ground plane is positioned on the second side.

10. The method of claim 9, further comprising:

attaching a waveguide to the first side of the substrate assembly, wherein the waveguide encloses the waveguide antenna element and is electrically connected to the first reference ground plane.

11. The method of claim 10, wherein the waveguide is a circular waveguide.

12. The method of claim 9, further comprising:

positioning one or more additional substrates between the waveguide antenna element and the stripline, wherein the stripline is proximity coupled to the waveguide antenna element.

13. The method of claim 9, further comprising:

providing a slot within the waveguide antenna element.

14. The method of claim 9, further comprising:

providing one or more vias electrically shorting the first reference ground plane to the second reference ground plane.

15. The method of claim 9, wherein the waveguide antenna element, the first reference ground plane, the stripline, and the second reference ground plane is provided using a subtractive process, an additive process, or a combination thereof.

16. The method of claim 15, wherein the subtractive process includes laser etching, milling, wet etching, or a combination thereof, and wherein the additive process includes printing, deposition, or a combination thereof.

17. The method of claim 9, wherein bonding the first substrate, the second substrate, and the third substrate together comprises:

positioning bonding layers between each of the first substrate, the second substrate, and the third substrate.

18. A method comprising:

receiving an electromagnetic signal from a waveguide at a waveguide antenna element positioned on a first side of a substrate assembly, wherein the waveguide antenna element is enclosed by a reference ground plane positioned on the first side of the substrate, wherein the electromagnetic signal induces a current having a circular behavior within the waveguide antenna element through electromagnetic induction, and wherein the current induces a second current at a stripline proximity coupled to the waveguide antenna element, wherein the waveguide antenna element and the first reference ground plane are positioned on a first substrate of the substrate assembly, wherein the stripline is positioned on a second substrate of the substrate assembly, and wherein the second reference ground plane is positioned on a third substrate of the substrate assembly.

19. The method of claim 18, wherein the electromagnetic signal has a frequency of about 10 GHz.

20. The method of claim 18, wherein the first substrate, the second substrate, and the third substrate each include a dielectric material.

* * * * *